US008011314B2

(12) United States Patent
McGeever et al.

(10) Patent No.: US 8,011,314 B2
(45) Date of Patent: Sep. 6, 2011

(54) PERSONAL DIVE DEVICE WITH ELECTRONIC SPEED CONTROL

(76) Inventors: Benjamin McGeever, Shoreline, WA (US); Andrew Georgitsis, Los Gatos, CA (US)

( * ) Notice: Subject to any disclaimer, the term of this patent is extended or adjusted under 35 U.S.C. 154(b) by 288 days.

(21) Appl. No.: 12/416,800

(22) Filed: Apr. 1, 2009

(65) Prior Publication Data

US 2009/0249991 A1 Oct. 8, 2009

Related U.S. Application Data

(60) Provisional application No. 61/041,815, filed on Apr. 2, 2008, provisional application No. 61/045,696, filed on Apr. 17, 2008.

(51) Int. Cl.
*B63C 11/46* (2006.01)

(52) U.S. Cl. ..... 114/315; 440/6

(58) Field of Classification Search ..... 114/315; 440/6

See application file for complete search history.

(56) References Cited

U.S. PATENT DOCUMENTS

| | | | | |
|---|---|---|---|---|
| 6,111,401 | A * | 8/2000 | Mierzwinski | 324/173 |
| 6,823,813 | B2 * | 11/2004 | Mazin | 114/315 |
| 6,848,385 | B2 * | 2/2005 | Mah | 114/315 |
| 2001/0029133 | A1 * | 10/2001 | Breems | 440/6 |

* cited by examiner

*Primary Examiner* — Stephen Avila
(74) *Attorney, Agent, or Firm* — Merchant & Gould P.C.

(57) ABSTRACT

A personal dive device includes a body having a power source that is disposed in the body with a voltage of the power source being greater than or equal to about 37 volts. A controller is in electrical communication with the power source. A rotary device is in selective electrical communication with the controller and a propeller assembly is engaged with the rotary device. A method for controlling the speed of a personal dive device includes providing a personal dive device having a power source disposed within a body and an electronic controller. A signal from a trigger mechanism is received. An effective power output from the power source is varied based on the signal from the trigger mechanism. The effective power output from the power source is provided to a rotary device that is in selective electrical communication with the electronic controller.

5 Claims, 7 Drawing Sheets

PERSONAL DIVE DEVICE WITH ELECTRONIC SPEED CONTROL

RELATED APPLICATIONS

This application claims the benefit of U.S. Patent Application Ser. No. 61/041,815 filed on Apr. 2, 2008, and U.S. Patent Application Ser. No. 61/045,696 filed on Apr. 17, 2008, the entireties of which are hereby incorporated by reference.

BACKGROUND

Diver propulsion vehicles are used to propel scuba divers underwater during underwater expeditions. One performance factor that can be important to the user is the run time/range of the vehicle. Longer run times/ranges are desirable. Two other factors of importance to the usability and availability of the vehicle are its size/weight and cost. Large size, weight, and cost are detrimental.

A battery is typically used to power such a vehicle. The battery is conventionally a large component in the vehicle, so this increases the size and weight and/or increases the cost. However, there are other aspects of the vehicle that effect performance in terms of range and run time.

In conventional diver propulsion vehicles, the speed or thrust of the vehicle is regulated by adjusting the pitch of the propeller. However, such propellers are not optimized for efficiency and are susceptible to propeller deflection at high speeds, leading to further losses in efficiency. Low efficiencies means more battery power is required for a give range/run time.

In conventional diver propulsion vehicles, the maximum speed of the vehicle is very close to most users' desirable speed. The motor is not optimized for efficiency at the users' desirable speed. This is means the motor rarely runs at its most efficient point. Low efficiencies mean more power is required for a give range/run time.

SUMMARY

An aspect of the present disclosure relates to a personal dive device having a body. A power source is disposed in the body with a voltage of the power source being greater than or equal to about 37 volts. A controller is in electrical communication with the power source. A rotary device is in selective electrical communication with the controller and a propeller assembly is engaged with the rotary device.

Another aspect of the present disclosure relates to a personal dive device having a body with a power source disposed within the body. A propulsion assembly is engaged with the body. The propulsion assembly includes a controller in electrical communication with the power source. A trigger mechanism is in selective electrical communication with the electronic controller. A rotary device is in selective electrical communication with the electronic controller. A propeller assembly is engaged with the rotary device. The propeller assembly includes a hub and a plurality of blades. The plurality of blades is rigidly engaged to the hub.

Another aspect of the present disclosure relates to a method for controlling the speed of a personal dive device. The method includes providing a personal dive device having a power source disposed within a body and an electronic controller in electrical communication with the power source. A voltage of the power source is greater than or equal to 37 volts. A signal from a trigger mechanism that is in selective communication with the electronic controller is received. An effective power output from the power source is varied based on the signal from the trigger mechanism. The effective power output from the power source is provided to a rotary device that is in selective electrical communication with the electronic controller.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
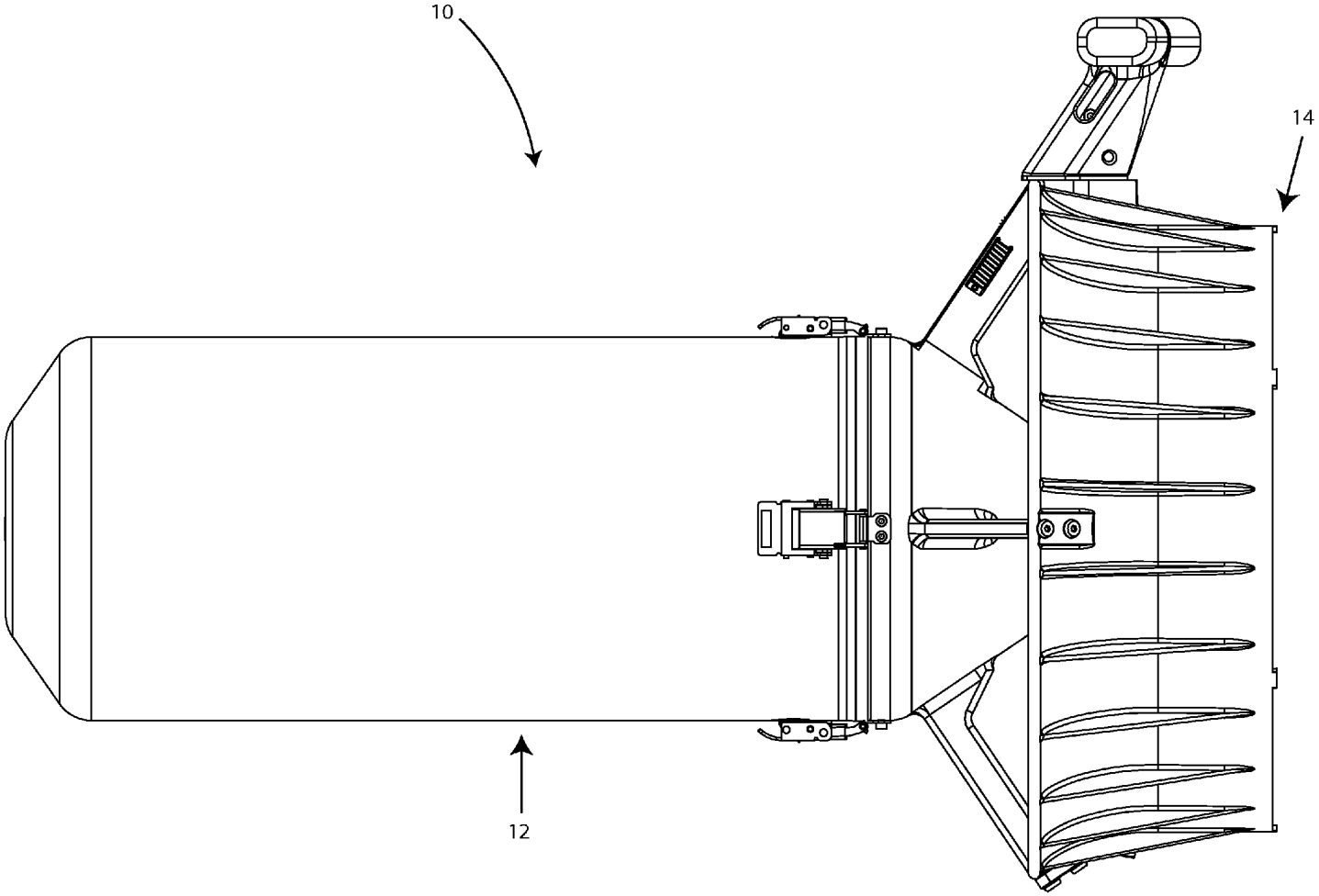
FIG. 1 is a perspective view of a personal dive device having exemplary features of aspects in accordance with the principles of the present disclosure.
Figure 2:
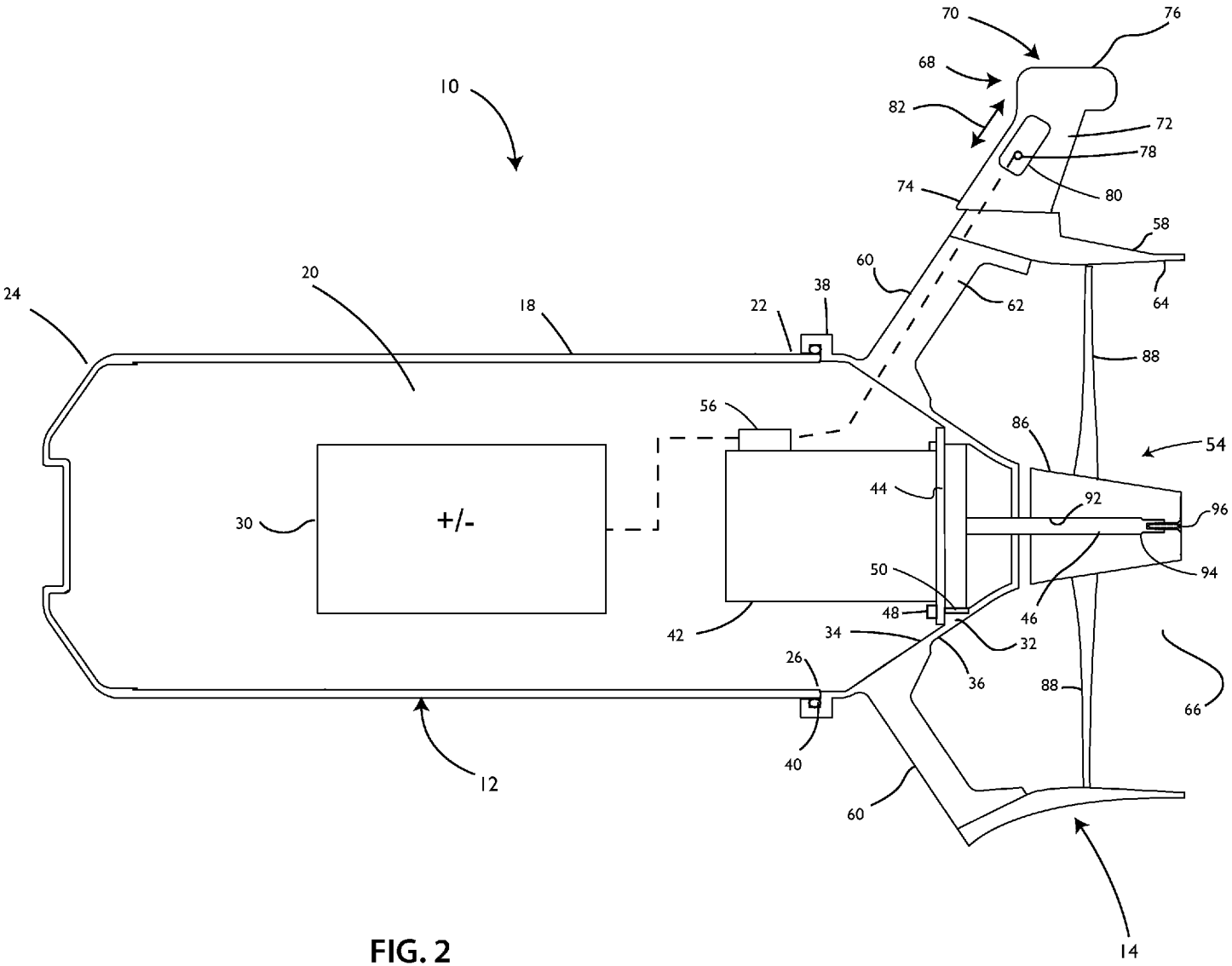
FIG. 2 is a schematic representation of the personal dive device of FIG. 1.

Referring now to FIGS. 1 and 2, a personal dive device, generally designated 10, is shown. The personal dive device 10 includes a body, generally designated 12, and a propulsion assembly, generally designate 14.

The example personal dive devices shown herein are configured for personal, single person usage; however other embodiments may be configured for use with more than one person.

The body 12 defines a sidewall 18 that includes an interior cavity 20. In the subject embodiment, the body 12 is cylindrical in shape. The scope of the present disclosure is not limited to the body 12 being cylindrical in shape. In one embodiment, the body 12 is made of thin-walled aluminum. The body 12 includes a first end 22 and an oppositely disposed second end 24. The first end 22 defines an opening 26 that extends into the interior cavity 20.

A power source 30 is disposed in the interior cavity 20 of the body 12. In the subject embodiment, the power source 30 is a battery such as a Nickel Metal Hydride (NiMH) battery or a Lithium (Li) Ion battery, but other battery chemistries can be used. Other embodiments may use any other source of electrical power not generally referred to as batteries, such as, for example but not limited to, fuel cells.

Referring now to FIG. 2, the propulsion assembly 14 includes a base 32. The base 32 includes a first side 34 and a second side 36. The base 32 further includes an outer lip portion 38 that extends outwardly from the first side 34. In the subject embodiment, the base 32 is engaged with the first end 22 of the body 12 at the opening 26 such that the first side 34 faces the opening 26 of the first end 22. In one embodiment, the engagement between the first end 22 and the base 32 is a sealing engagement that prevents the ingress of fluid into the interior cavity 20. A sealing member 40 (i.e., o-ring, gasket, etc.) is disposed between an inner surface of the outer lip portion 38 of the base 32 and an outer surface of the sidewall 18 at the first end 22 of the body 12. The sealing member 40 seals the base 32 and the first end 22 when the base 32 and the first end 22 are engaged. The present disclosure is not limited to this sealing arrangement; other sealing arrangements may be used.

Figure 3:
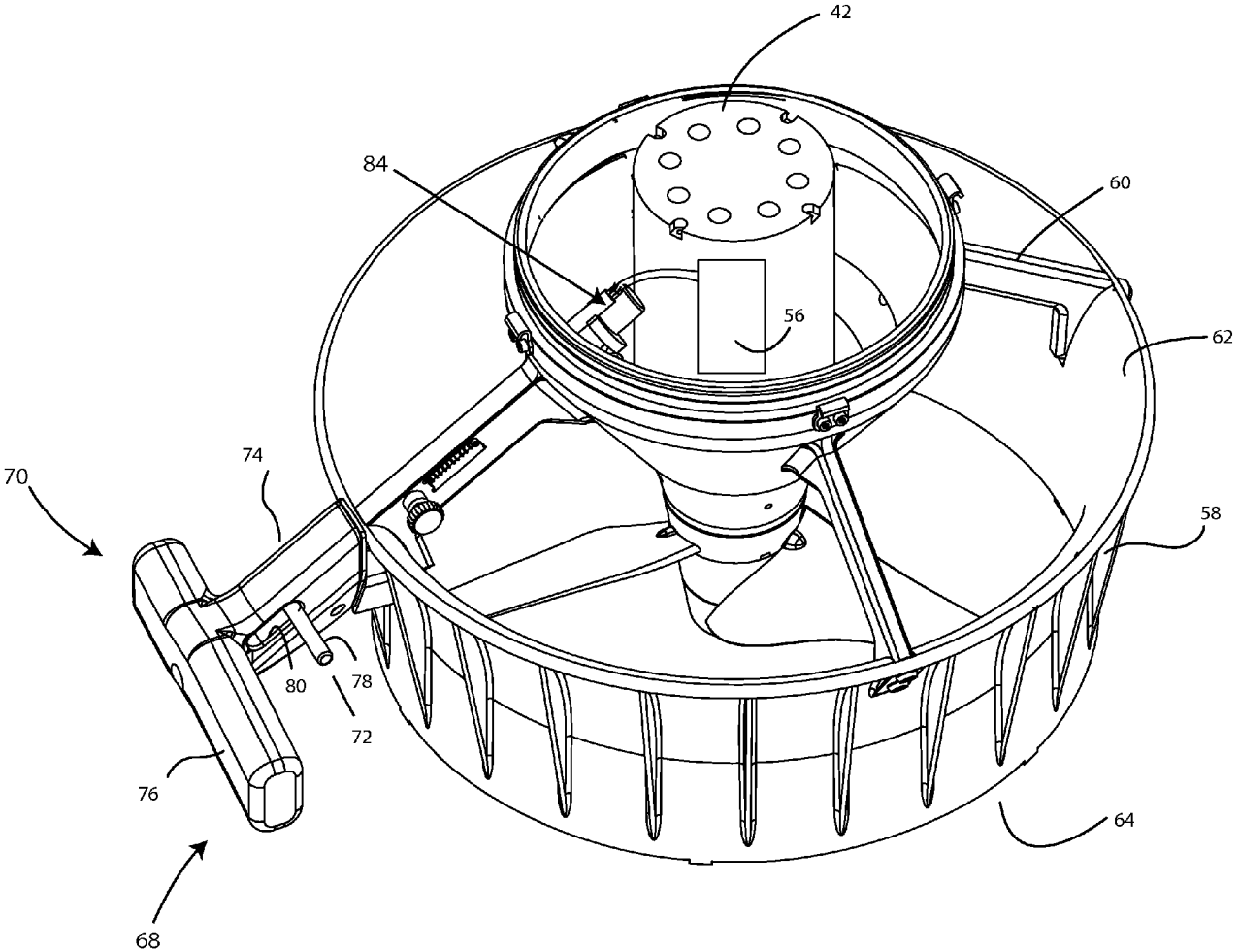
FIG. 3 is a perspective view of an exemplary propulsion assembly suitable for use with the personal dive device of FIG. 1.

Referring now to FIGS. 2 and 3, the propulsion assembly 14 further includes a rotary device 42. In the subject embodiment, the rotary device 42 includes a flange portion 44 and an output shaft 46 that is rotatably engaged with the rotary device 42.

The flange portion 44 of the rotary device 42 is mounted to the first side 34 of the base 32 by a plurality of fasteners 48 (e.g., bolts, screws, etc.). The fasteners 48 are engaged with mounting holes 50 defined by the first side 34 of the base 32.

In the subject embodiment, the rotary device 42 is a brushless motor. The brushless motor 42 is a synchronous electric motor that defines linear relationships between current and torque and voltage and rpm. The brushless motor 42 includes a stator, which is a stationary component, and a rotor that rotates within the stator about a fixed axis. Rotation of the rotor in the stator is provided by electromagnetic induction. Electromagnets are mounted to the stator, while permanent magnets are mounted to the rotor. By alternating current to the electromagnets of the stator, a rotating magnetic field is produced. This magnetic field produced by the electromagnets of the stator induces rotation of the permanent magnets mounted on the rotor, which results in rotation of the rotor. In the subject embodiment, the output shaft 46 is directly or indirectly connected to the rotor. Therefore, rotation of the rotor results in rotation of the output shaft 46.

In the depicted embodiment, the propulsion assembly 14 further includes an electronic controller 56, which is used to vary the speed and power of the rotary device 42. The electronic controller 56 is in electrical communication with the power source 30 and the rotary device 42 and electronically controls power from the power source 30 to the rotary device 42.

To operate and control the speed and power of the rotary device 42, the controller uses information about the angular position of the stator and rotor within the rotary device 42. To obtain this information, the electronic controller 56 uses internal sensing devices monitoring the electrical connection between the electronic controller 56 and the rotary device 42. This methodology is commonly referred to as "sensorless," but other names may be used, as no sensors are required within or on the rotary device 42. Other methodologies may be used.

In the subject embodiment, the controller 56 is mounted to the rotary device 42. The scope of the present disclosure is not limited to the controller being mounted to the rotary device, as other arrangements are possible.

The propulsion assembly 14 includes an outer housing 58 that is connectedly engaged with the base 32 through a plurality of ribs 60. The outer housing 58 includes a forward end 62 and a rearward end 64. In the subject embodiment, the plurality of ribs 60 extends radially inward from the forward end 62 of the outer housing 58 and is connectedly engaged to the base 32.

The outer housing 58 defines an interior bore 66. In the subject embodiment, the forward and rearward ends 62, 64 are open such that fluid can pass through the interior bore 66 of the outer housing 58 during operation of the personal dive device 10. In the depicted embodiment of FIGS. 2 and 3, the propeller assembly 54 is disposed in the interior bore 66 of the outer housing 58.

A handle assembly, generally designated 68, is disposed on an outer surface of the outer housing 58. The handle assembly 68 includes a handle, generally designated 70, and a trigger mechanism, generally designated 72.

The handle 70 includes a first portion 74 and a second portion 76. In the subject embodiment, the first portion 74 is connectedly engaged with the outer housing 58 such that the first portion 74 extends radially outwardly from the outer surface of the outer housing 58.

The second portion 76 of the handle 70 serves as a hand grip. In the depicted embodiment, the second portion 76 is generally perpendicular to the first portion 74. The scope of the present disclosure is not limited to the second portion 76 being generally perpendicular to the first portion 74, as other handle arrangements that ergonomically suit the hand may be used.

In the depicted embodiment, the arrangement of the handle 70 and the trigger mechanism 72 allows for complete operation and control of the vehicle using a single hand. The vehicle orientation and direction is controlled via the hand grip 76 and the vehicle speed via trigger mechanism 72. Other embodiments may arrange these components in different locations, requiring more than one hand for operation, however the arrangements requiring single handed operation are optimal.

The trigger mechanism 72, which is disposed within the first portion 74 of the handle 70, includes a lever 78. The lever 78 of the trigger mechanism 72 extends outwardly from a slot 80 defined by the first portion 74 of the handle 70. In the subject embodiment, the lever 78 is generally parallel to the second portion 76 of the handle 70 and is selectively movable in a direction 82 (shown as an arrow in FIG. 2) from a first position (shown in FIG. 3) to a second position (shown in FIG. 2). In one embodiment, the lever 78 is biased to the first position (FIG. 3) by a spring.

The lever 78 can be selectively actuated by moving the lever 78 from the first position (FIG. 3) to the second position (FIG. 2) and then releasing the lever 78 such that the lever 78 returns to the first position. In one embodiment, actuation of the lever 78 actuates a reed switch 84 that is in electrical communication with the controller 56. The scope of the present disclosure is not limited to a reed switch, as other sensors may be used.

In one embodiment, multiple actuations of the reed switch 84 by the lever 78 vary the speed of the rotary device 42. For example, in one embodiment, the lever 78 is double clicked to go faster (i.e., speed up the motor propulsion) and single clicked to slow down. In the example shown, there is a plurality of speeds, such as five speeds. Acceleration through the speeds involves double clicks of the lever 78 to increase speed, and single clicks to decrease speed. Other configurations are possible.

Figure 4:
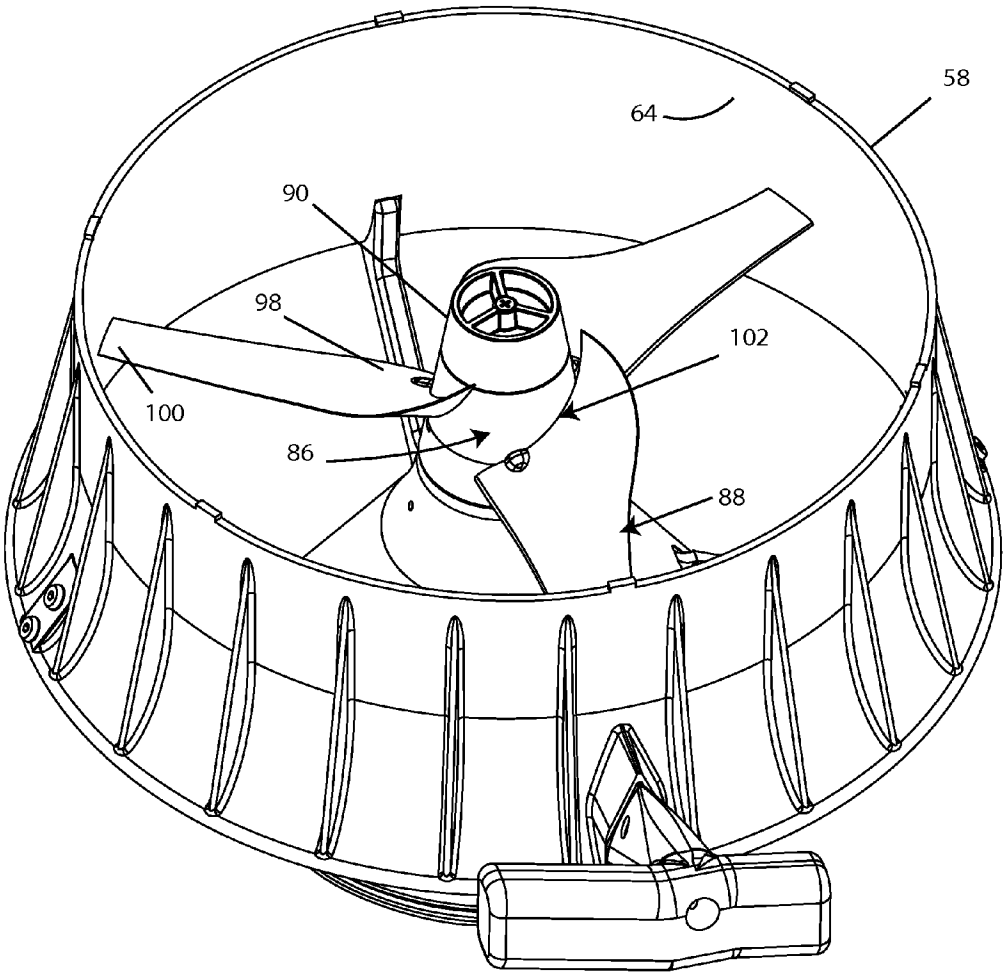
FIG. 4 is a perspective view of a propeller assembly suitable for use with the personal dive device of FIG. 1.

Referring now to FIGS. 2 and 4, the propeller assembly 54 is shown. The propeller assembly 54 includes a hub, generally designated 86, and a plurality of blades, generally designated 88. In the subject embodiment, and by way of example only, there are three blades 88.

The hub 86 includes an exterior surface 90. In the subject embodiment, the exterior surface 90 is generally partially conical in shape. It will be understood, however, that the scope of the present disclosure is not limited to being partially conical in shape. The hub 86 defines a bore 92 (shown in FIG. 2), which is engaged with an output end 94 (shown in FIG. 2)

of the output shaft 46 such that the hub 86 rotates with the output shaft 46 of the rotary device 42.

Each of the plurality of blades 88 includes a base end portion 98 and an oppositely disposed free end portion 100 that extends outwardly from the base end portion 98. The base end portion 98 of each of the blades 88 is in rigid engagement with the exterior surface 90 of the hub 86. In one embodiment, each of the base end portions 98 of the plurality of blades 88 is engaged to the hub 86 by a weld 102. The scope of the present disclosure is not limited to each of the plurality of blades 88 being welded to the hub 86. Other embodiments may be a one piece machined part, or a molded part, or an assembly that achieves the same rigid engagement between the blades and hub.

The rigid engagement of the base end portion 98 of each of the blades 88 to the hub 86 strengthens the interface between the propeller 88 and the hub 86. This strengthening of the interface between the propeller 88 and the hub 86 results in less deflection of the blades 88 as the power output of personal dive device 10 increases. As deflection of the blades 88 during operation of the personal dive device 10 results in efficiency losses of the propulsion assembly 14, the reduction or elimination of deflection of the blades 88 during operation of the personal dive device 10 provides a personal dive device 10 capable of increased power output at increased efficiencies.

In another embodiment, the personal dive device 10 is capable of increased efficiencies and more flexible usage at different speeds through digital modulation of the power source 30. In this embodiment, the power source 30 is a battery having a voltage that is greater than or equal to about 37 volts. In another embodiment, the power source 30 is a battery having a voltage that is greater than or about equal to 42 volts. In other examples, the voltage is equal to or does not exceed 50 volts, 75 volts, or 120 volts.

While the actual power output from the power source 30 is nominally constant during operation, an effective power output received by the rotary device 42 can be varied by digitally modulating the actual power output of the power source 30. In one example, digital modulation of the power source can be accomplished using pulse-width modulation (PWM). In pulse-width modulation, the effective power output of the power source 30 is an average of the power output over a given period of time.

Figure 5:
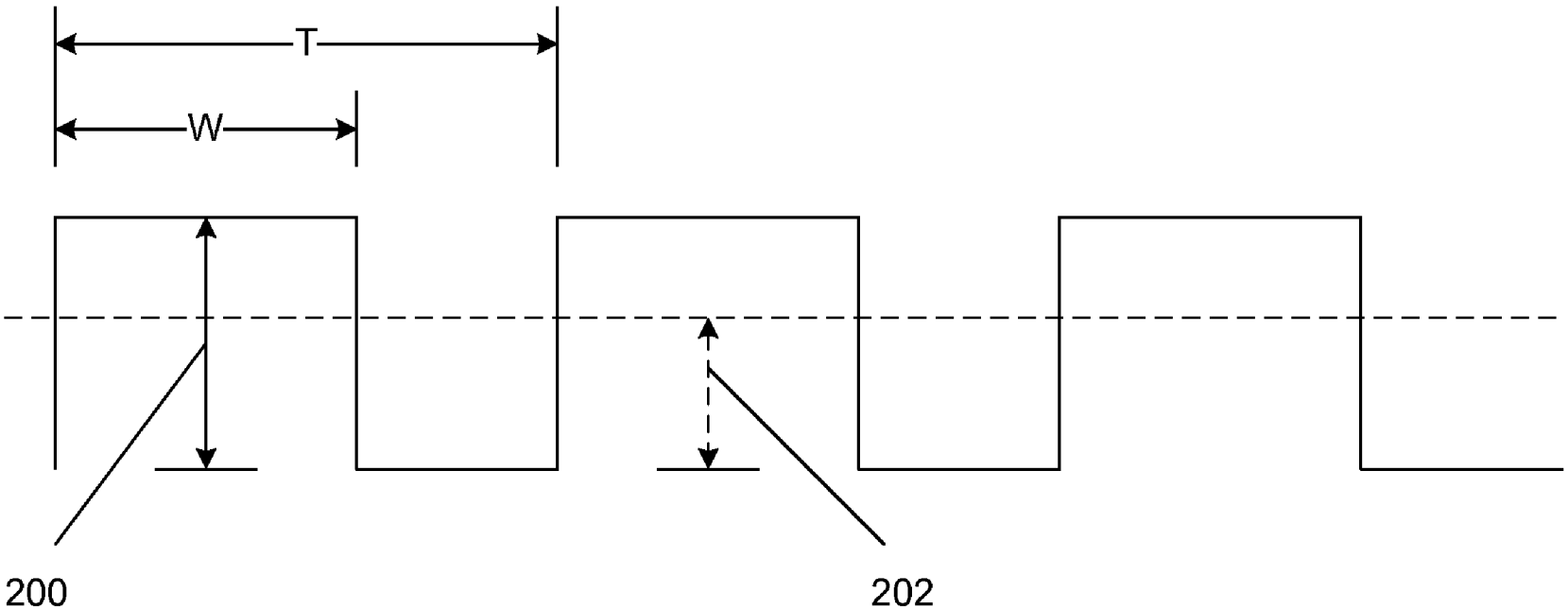
FIG. 5 is a schematic representation of a power output from a power source

Referring now to FIG. 5, a graph of the power output of the power source 30 is shown. The actual power output of the power source 30 is shown by an arrow having a reference numeral 200. However, by modulating the power source 30 between an active and inactive state, the effective power output can be controlled. In the depicted example of FIG. 5, the power source 30 is active (shown by reference numeral W) for approximately 60% of a period of time T. As a result, an effective power output (shown as a dashed arrow with reference numeral 202) is about 60% of the actual power output 200.

The scope of the present disclosure is not limited PWM, as other power control methodologies may be used in the electrical controller. PWM is described as an example. The electronic controller may also be configured so that whenever a power output change is commanded it slowly implements this change in power, using a predetermined rate of change. This smoothing of the change has benefits to both the user and equipment.

Figure 6:
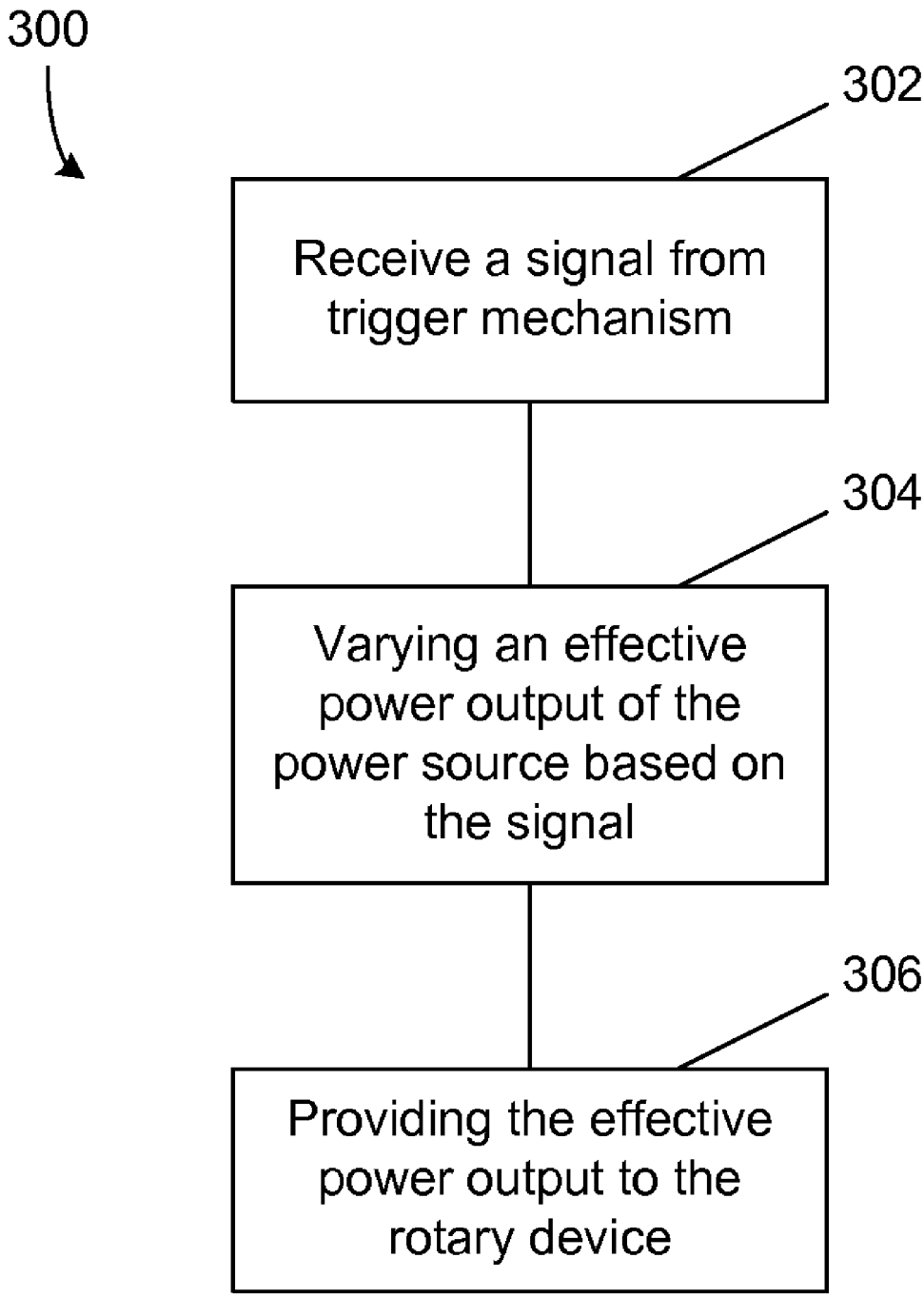
FIG. 6 is a flow diagram of a method for controlling the speed of a personal dive device.

Referring now to FIG. 6, a method 300 for controlling the speed of the rotary device 42 is shown. In step 302, the electronic controller 46 receives a signal from the trigger mechanism 72. The signal sent to the electronic controller 46 from the trigger mechanism 72 is based on the actuation of the trigger mechanism 72. The trigger mechanism 72 is actuated to either increase or decrease the speed of the rotary device 42. In the subject embodiment, and by way of example only, the trigger mechanism 72 is actuated twice to increase the speed of the rotary device 42 and actuated once to decrease the speed of the rotary device 42. If, as in the subject embodiment, the rotary device 42 is a five-speed device, each double actuation of the trigger mechanism 72 increases the speed of the rotary device 42 by about 20% until the maximum speed is reached while each single actuation of the trigger mechanism 72 decreases the speed of the rotary device 42 by about 20% until the minimum speed is reached.

Figure 7:
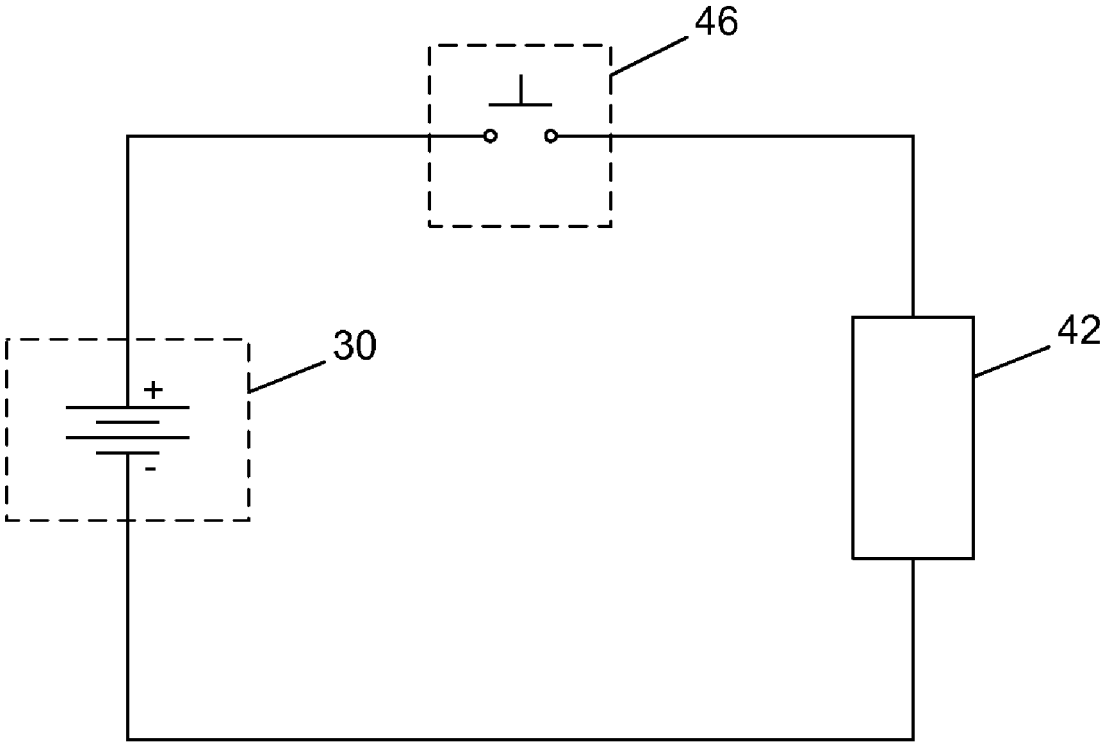
FIG. 7 is a simplified electrical schematic of the personal dive device of FIG. 1.

In step 304, the electronic controller 46 varies the effective power output 202 of the power source 30 in response to the actuation of the trigger mechanism 72. In the subject embodiment, the effective power output 202 is varied by increasing or decreasing the duration W during which the power source 30 is active. As shown schematically in FIG. 7, the duration W, during which the power source 30 is active, can be varied by the electronic controller 46 by the actuation of a switch. In the subject embodiment, the duration W is directly proportional to the effective power output. For example, if the duration W is increased, the effective power output 202 is increased. If the duration W is decreased, the effective power output 202 is decreased.

In step 306, the electronic controller 46 provides the effective power output 202 to the rotary device 42. In response to the effective power output 202, the rotary device 42 operates at a speed and power. If the effective power output 202 decreases, the speed and power of the rotary device 42 decreases. If the effective power output 202 increases, the speed and power of the rotary device 42 increases. It will be understood, however, that while step 306 is shown following step 304, step 306 may occur simultaneously with step 304.

There can be various advantages associated with the personal dive devices described herein.

In some embodiments, it is advantageous to increase battery and/or motor size so that the optimal running efficiencies can be achieved at typical operating speeds. For example, the motor and/or battery can be sized to be capable of operating at greater than typical speeds (e.g., roughly twice typical speeds), and electronic speed control can be used to operate at a usable typical speed. In such a configuration, the motor can be operated close to its optimal point at typical speeds, thereby increasing efficiency. These higher voltage motors are generally more efficient. The larger, higher voltage motor gives the vehicle a higher top speed, useful in emergency situations such as high currents or tides.

The larger, higher voltage motors offer the user a larger range of speeds, using this range of speeds is easier for the user if they are selectable using the same hand with which they are operating the vehicle. Many conventional vehicles use a control that requires using the second hand.

With larger, higher voltage motors the starting power requirements are higher. This spike can be hard on and potentially damaging to the controller, or require a larger controller to handle it. Setting the controller to slowly increase the speed on startup, for example over a one-half second time period, reduces this spike. This ramp is also beneficial to the operator who sees a smooth acceleration as opposed to a sudden jerk.

The use of brushless motors is advantageous. Brushless motors are generally more efficient than brushed motors used in most conventional vehicles. Brushless motors are smaller and lighter than there equivalent brushed motor. As the motor is smaller and lighter than the equivalent brushed motor, using a higher power motor at 37 volts or above has less impact on the size and weight of the vehicle. Brushless motors do not have brushes, a mechanical assembly with a defined lifespan, and reliability issues when used in a marine environment. At voltages over 37 volts, the brushes on conventional brushed motors would suffer accelerated wear. Brushless motors only have a rotor and a winding, this makes them very suitable for a marine environment as the simplicity of its component parts make them relatively immune to damp and water.

The rigid prop can be heavily optimized for an optimal speed, matching the optimized motor thereby increasing efficiency. Fixed pitch props are more suitable for a structurally stiffer design, so they don't suffer from deflection under load, and the loss of efficiency this leads to. Variable pitch props used in conventional vehicles have a multitude of internal parts to adjust the pitch. This complexity leads to issues with spares part count, maintenance procedures, personnel skill requirements, and risk of miss-assembly. A single piece fixed pitch prop eliminates nearly all of these issues. A fixed pitch prop is very suitable to an optimized design for efficiency and performance. The designer can be ensured the prop is rigid and will not deflect, it does not have to be designed well to operate over a range of settings, and there is no adjustment required.

Multiple motor speeds allow the vehicle to operate at different speeds without changing the prop. The conventional method of adjusting speed using an adjustable pitch prop often results in the vehicle being used an non optimal pitch settings As the use of pulse-width modulation results in the power source being intermittently activated and inactivated, noise (e.g., vibration, etc.) can result. Depending upon the severity of the noise produced, such noise can make a device uncomfortable to use for extended lengths of time. By rigidly engaging the blades to the hub of the propeller assembly, the noise at this interface is potentially reduced.

The use of sensorless components is also advantageous. A sensored electronic controller requires sensors in the motor to communicate the motor position, allowing the controller to correctly function. These sensors require wires connecting them to the controller. These additional parts, not required in a sensorless controller, add a reliability risk in the marine environment in which the vehicles operate.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for controlling the speed of a personal dive device, the method comprising:

providing a personal dive device having a power source disposed within a body and an electronic controller in electrical communication with the power source, wherein a voltage of the power source is greater than or equal to about 37 volts;

receiving a signal from a trigger mechanism that is in selective communication with the electronic controller;

varying an effective power output from the power source based on the signal from the trigger mechanism; and providing the effective power output from the power source to a rotary device that is in selective electrical communication with the electronic controller, wherein the power output from the power source is a square wave that is modulated by varying a proportion of time the power output is sent to the rotary device, and a single actuation of the trigger mechanism decreases the proportion of time the power output is sent to the rotary device.

2. A method for controlling the speed of a personal dive device as claimed in claim 1, wherein a double actuation of the trigger mechanism increases the proportion of time the power output is sent to the rotary device.

3. A method for controlling the speed of a personal dive device as claimed in claim 1, wherein the signal is based on a desired power output.

4. A method for controlling the speed of a personal dive device as claimed in claim 3, wherein the power output is varied such that an average of the power output over a period of time is about equal to the desired power output.

5. A method for controlling the speed of a personal dive device as claimed in claim 3, wherein the rotary device includes a propeller assembly having a hub and a plurality of blades that are rigidly engaged to the hub.

* * * * *